US011002425B1

(12) United States Patent
Chen et al.

(10) Patent No.: US 11,002,425 B1
(45) Date of Patent: May 11, 2021

(54) OPTICAL COVER WITH FACETED SURFACE

(71) Applicant: ABL IP Holding LLC, Atlanta, GA (US)

(72) Inventors: Jie Chen, Snellville, GA (US); Melissa Ricketts, Conyers, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/812,937

(22) Filed: Mar. 9, 2020

Related U.S. Application Data

(60) Provisional application No. 62/815,698, filed on Mar. 8, 2019.

(51) Int. Cl.
*F21V 5/04* (2006.01)
*F21Y 103/00* (2016.01)
*F21Y 115/10* (2016.01)

(52) U.S. Cl.
CPC ..... *F21V 5/045* (2013.01); *F21Y 2103/00* (2013.01); *F21Y 2115/10* (2016.08)

(58) Field of Classification Search
CPC ..... F21Y 2103/10; F21V 13/04
See application file for complete search history.

(56) References Cited

U.S. PATENT DOCUMENTS 1,941,079 A 12/1933 Exelmans
5,633,623 A 5/1997 Campman
7,467,876 B2 12/2008 Segawa
7,559,672 B1 7/2009 Parkyn et al.
7,878,690 B2 2/2011 Kawato et al.
8,690,380 B2 4/2014 Sato et al.
8,944,624 B2 2/2015 Kim et al.
8,998,448 B2 4/2015 Chang
9,423,097 B2 8/2016 Haenen et al.
9,476,566 B2 10/2016 Lu et al.
9,822,951 B2 11/2017 Lu et al.
D822,885 S 7/2018 Tweel et al.
10,317,021 B2 6/2019 Magno et al.
10,655,803 B2 5/2020 Magno et al.
(Continued)

OTHER PUBLICATIONS

U.S. Appl. No. 15/441,940 , "Non-Final Office Action", dated Jun. 29, 2018, 6 pages.

(Continued)

*Primary Examiner* — Evan P Dzierzynski
(74) *Attorney, Agent, or Firm* — Kilpatrick Townsend & Stockton LLP

(57) ABSTRACT

An optical cover for a linear light source includes a portion of an optical material that forms a cross-section transverse to an axial direction. The cross-section curves so that its inner surface is substantially concave and its outer surface is substantially convex. The outer surface is substantially smooth, and the inner surface forms facets. Each of the facets refracts light, and connects with an adjacent facet. Each of the facets defines a peak height from the outer surface, and each pair of adjacent facets defines a valley height from the outer surface. The peak heights of all facets exceed the valley heights between adjacent pairs of facets, and the peak height of each selected facet does not exceed twice the valley height between the selected facet and a facet adjacent to the selected facet.

19 Claims, 7 Drawing Sheets

(56) References Cited

U.S. PATENT DOCUMENTS

| | | | | |
|---|---|---|---|---|
| 2013/0176722 | A1* | 7/2013 | Lay | F21V 7/28 362/231 |
| 2015/0362132 | A1 | 12/2015 | McCane et al. | |
| 2016/0025905 | A1 | 1/2016 | Teather et al. | |
| 2017/0051895 | A1 | 2/2017 | Gielen et al. | |
| 2017/0268744 | A1 | 9/2017 | Hsia | |
| 2018/0328546 | A1 | 11/2018 | Xu et al. | |
| 2019/0186710 | A1* | 6/2019 | Lim | F21V 13/04 |
| 2019/0277459 | A1 | 9/2019 | Magno et al. | |

OTHER PUBLICATIONS

U.S. Appl. No. 15/441,940 , "Response to Non-Final Office Action", dated Sep. 18, 2018, 9 pages.
U.S. Appl. No. 16/421,422 , "Non-Final Office Action", dated Sep. 3, 2019, 6 pages.
U.S. Appl. No. 16/421,422 , "Notice of Allowance", dated Jan. 10, 2020, 8 pages.

* cited by examiner

OPTICAL COVER WITH FACETED SURFACE

CROSS-REFERENCE TO RELATED APPLICATIONS

This is a non-provisional application of, and claims priority to, U.S. Provisional Patent Application Ser. No. 62/815,698, filed 8 Mar. 2019, which is hereby incorporated by reference in its entirety for all purposes.

BACKGROUND

Some lighting applications are based on essentially linear light sources, such as fluorescent tubes or light-emitting diodes (LEDs) that are arranged in a row. Allowing light from the light source(s) to emit light in uncontrolled directions can be inefficient and/or harmful in that light is not placed where it is needed and/or kept away from directions where it is undesirable. Thus, some of these applications benefit from optics to tailor the distribution of light. However, certain types of optics can be heavy and/or costly (e.g., from using large volumes of refractive optical material, and/or multiple elements such as separate lenses and covers), inefficient (absorbing some of the light and turning it into heat) and/or unsightly (providing a visually "busy" appearance, generating high angle light that is perceived as glare, and the like).

SUMMARY

In an embodiment, an optical cover for a linear light source is configured to emit light, defines a linear axis, extends along an axial direction, and includes a portion of an optical material that extends in the axial direction. The portion of the optical material forms a constant cross-section transverse to the linear axis. The cross-section is curved so that an inner surface of the cross-section is substantially concave and an outer surface of the cross-section is substantially convex. The outer surface of the cross-section is substantially smooth. The inner surface of the cross-section forms a plurality of facets. Each of the facets forms a refractive surface that refracts a corresponding portion of the light, and a return surface that connects the refractive surface with a refractive surface of an adjacent facet. Each of the facets defines a peak height from the outer surface where the refractive surface adjoins the return surface. Each pair of adjacent facets defines a valley height from the outer surface where the return surface of one facet adjoins the refractive surface of the adjacent facet. The peak heights of all facets exceed the valley heights between all adjacent pairs of facets. The peak height of any selected facet does not exceed twice the valley height between the selected facet and a facet adjacent to the selected facet.

In an embodiment, a method of reconfiguring a light distribution of a luminaire that projects light from a substantially linear light source that extends along an axial direction is provided. The method includes decoupling a first optical cover from the luminaire. The first optical cover is formed of a first portion of a first optical material. The first portion forms a first cross-section transverse to the axial direction. A first outer surface of the first cross-section is substantially smooth, and a first inner surface of the first cross-section forms a plurality of first facets. Each of the first facets forms a first refractive surface that refracts a corresponding portion of the light, and a first return surface that connects the first cross-section to a first refractive surface of an adjacent facet. When the substantially linear light source emits light towards the first optical cover, each of the first refractive surfaces refracts the corresponding portion of the light away from its original propagation direction into a first light distribution. The method further includes coupling a second optical cover with the luminaire. The second optical cover is formed of a second portion of a second optical material. The second portion forms a second cross-section transverse to the axial direction. A second outer surface of the second cross-section is substantially smooth. A second inner surface of the second cross-section forms a plurality of second facets. Each of the second facets forms a second refractive surface that refracts a corresponding portion of the light, and a second return surface that connects the second cross-section to a second refractive surface of an adjacent facet. When the substantially linear light source emits light towards the second optical cover, each of the second refractive surfaces refracts the corresponding portion of the light away from its original propagation direction into a second light distribution. One or more of the second refractive surfaces form different angles than the first refractive surfaces, so that the second light distribution is different from the first light distribution.

BRIEF DESCRIPTION OF THE DRAWINGS

The present disclosure is described in conjunction with the appended figures.

DETAILED DESCRIPTION

Figure 1:
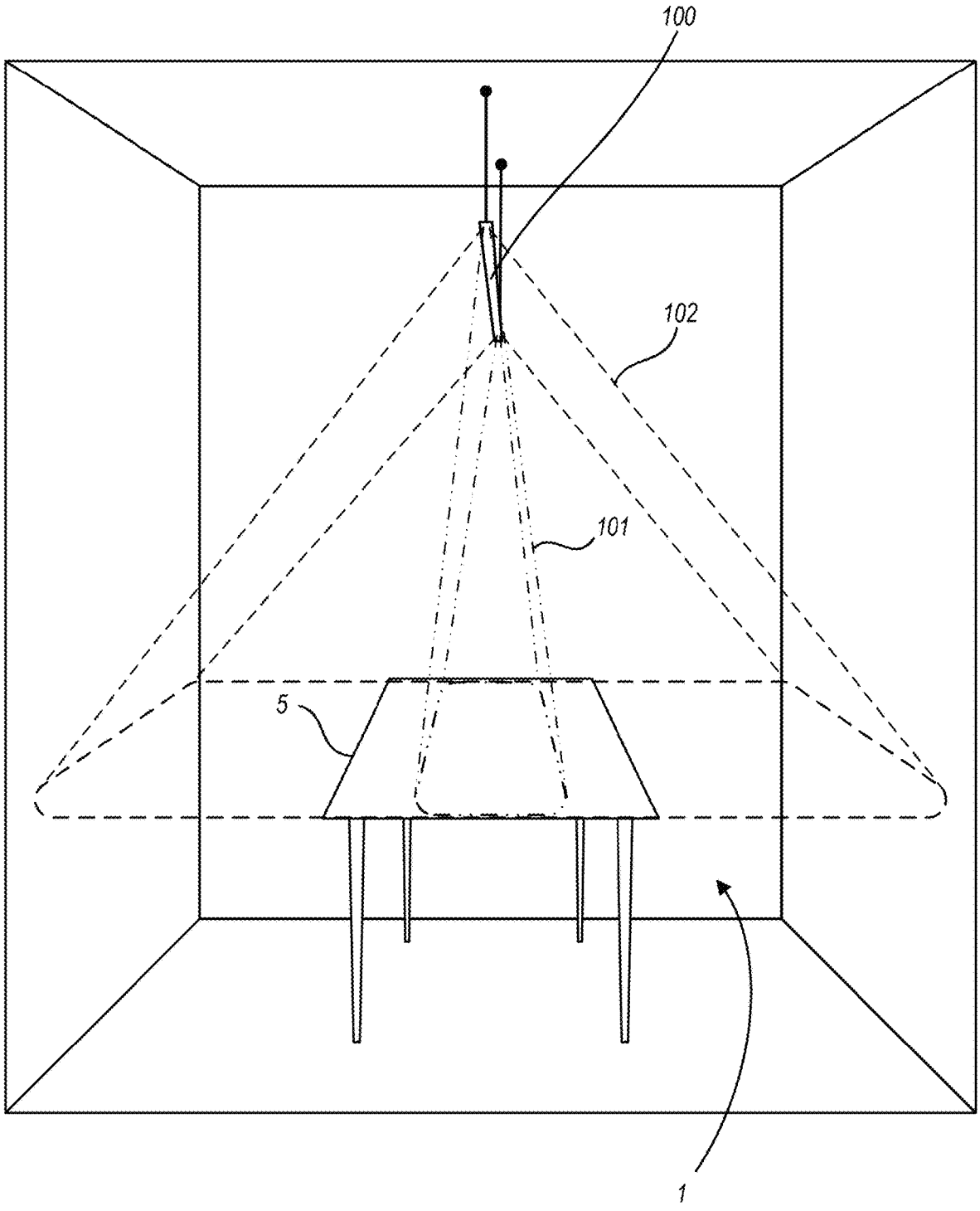
FIG. 1 schematically illustrates a light fixture having an optical cover with a faceted surface, illuminating portions of a space, in accord with one or more embodiments.

The present disclosure may be understood by reference to the following detailed description taken in conjunction with the drawings described below, wherein like reference numerals are used throughout the several drawings to refer to similar components. It is noted that, for purposes of illustrative clarity, certain elements in the drawings may not be drawn to scale. In instances where multiple examples of an item are shown, only some of the examples may be labeled, for clarity of illustration. Specific instances of an item may be referred to by use of a numeral followed by a dash and a second numeral (e.g., optical covers 130-1, 130-2, 130-3) while numerals not followed by a dash refer to any such item (e.g., optical covers 130).

The present disclosure refers descriptions such as "up," "down," "above," "below" and the like that are intended to convey their ordinary meanings in the context of the orientation of the drawings being described, notwithstanding that the apparatus disclosed may be manufactured and/or installed in other orientations.

Embodiments herein provide new and useful lighting modalities based on optical covers having internal faceting. Several embodiments are contemplated and will be discussed, but embodiments beyond the present discussion, or intermediate to those discussed herein are within the scope of the present application. Optical covers as described herein may be utilized in free-standing, pole-mounted, wall-mounted and/or ceiling-mounted luminaires, and may be utilized for indoor and/or outdoor lighting.

Embodiments herein appreciate that optical covers for linear light fixtures can advantageously combine optical, protection and reconfiguration functionalities that are typically provided by a combination of prior art optics and outer covers. In these embodiments, a section of optical material that extends along an axis uses faceting of the section's cross-sectional profile to redirect light passing therethrough. The faceting is advantageously applied to an internal surface of the cross-sectional profile, which minimizes variations in light in a direct view of the optical cover when the light sources are turned on, and provides the optical cover with a substantially smooth outer surface, for best aesthetic appearance. In this sense, "substantially smooth" means visibly smooth to the unaided eye, but the outer surface may be slightly textured to provide light diffusion, as discussed below. Provided in this way, the faceting allows an optical cover of a linear light fixture to provide all features typically provided by a separate optic and cover per fixture. A further advantage of these embodiments is that light distributions of light fixtures using these optical covers can be easily altered by replacing only the outside optical cover. That is, while optics of previous fixtures may not be directly accessible after installation, and would at least require a separate replacement step, optical covers herein are directly accessible after installation. Certain embodiments also feature further refinements for manufacturability, cost savings, convenience and optical performance, as disclosed herein.

FIG. 1 schematically illustrates a light fixture 100 having an optical cover with a faceted surface, illuminating portions of a space 1. Light fixture 100 may function as a fixture in and of itself, or may form a portion of a larger system that incorporates several light fixtures 100. The optical cover is not labeled in FIG. 1 due to the scale of the drawing; see FIGS. 2-7. The optical cover can be easily removed and replaced.

By using different optical covers, light fixture 100 can either project, for example, a narrow light distribution 101 (shown as lighting part of a table 5 below fixture 100), a wide light distribution 102 (shown as extending much further laterally than distribution 101), or other distributions not shown in FIG. 1. The shapes and edges of light distributions 101 and 102 are shown for purposes of illustration only; light distributions achievable with optical covers herein can vary significantly from those shown, and edges of such distributions may be bounded not by edges of the character suggested by FIG. 1, but by more diffuse edges.

Figure 2:
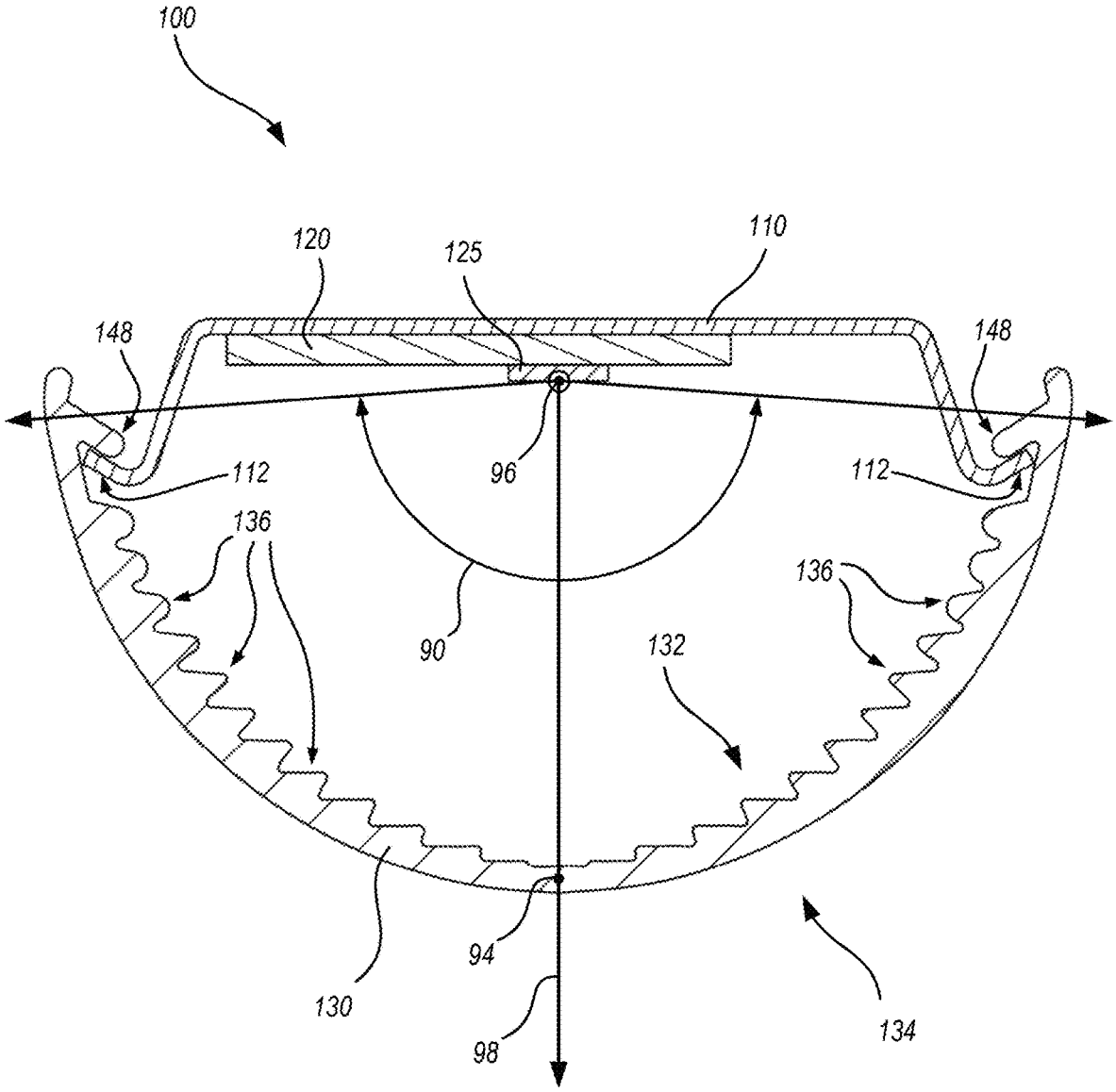
FIG. 2 is a schematic cross-sectional drawing illustrating certain components of the light fixture of FIG. 1, in accord with one or more embodiments.

FIG. 2 is a schematic cross-sectional drawing illustrating certain components of light fixture 100. Light fixture 100 includes a base 110 and a printed circuit board (PCB) 120 with a plurality of LEDs 125 that serve as light sources. Base 110 and PCB 120 are longer in an axial direction (in and out of the plane of FIG. 2) than a lateral direction (left and right in FIG. 2) so that LEDs 125 form a linear light source. A linear axis 96 is defined by the linear light source, with linear axis 96 being centered on LEDs 125, and extending in and out of the plane of FIG. 2. An optical cover 130 couples with base 110. Optical cover 130 advantageously combines light shaping with protection of PCB 120 and LEDs 125. In prior art light fixtures, light shaping would usually be accomplished by a primary optic, while protection would usually be provided by a separate outer cover. In order to combine these functions, an internal surface 132 of optical cover 130 (that is, the surface of optical cover 130 that faces LEDs 125, as opposed to an outer surface 134) includes facets 136. Facets 136 extend along the axial direction of optical cover 130 so as to modify the light from the linear light source provided by LEDs 125 as it passes through optical cover 130. Facets 136 can be modified to shape light according to any of several desired light distributions, as discussed further below. In FIG. 2, optical cover 130 is approximately semicylindrical, but this is not required. Many embodiments herein have a cross-section that is convex on the "outside" (a side away from LEDs 125) and concave on the "inside" (toward LEDs 125) but this, too, is not a requirement. In the embodiment illustrated in FIG. 2, the semicylindrical shape formed by optical cover 130 subtends an arc 90 of about 172° about linear axis 96; other embodiments may subtend an arc that is much smaller or larger, for example as little as sixty degrees or less, or as much as two hundred degrees or more. The semicylindrical arc subtended by optical cover 130 has midpoint 94. A line that is orthogonal to linear axis 96 (that is, parallel with the plane of FIG. 2) and passes through midpoint 94 defines an optical axis 98. Several useful properties achieved by facets 136 refracting light passing therethrough can be described with reference to optical axis 98.

Optical cover 130 also forms one or more coupling features 148 that can engage with one or more corresponding features 112 of base 110, to hold optical cover 130 in place. In certain embodiments, coupling features 148 of optical cover 130 and 112 of base 110 allow easy coupling and decoupling while base 110 is installed in a lighted space or a larger lighting system. For example, optical cover 130 may be flexible enough so that coupling features 148 can be positioned outside coupling features 112, and an installer can flex optical cover 130 so that coupling features can pass by, then snap into place around, coupling features 112. Alternatively, optical cover 130 can be positioned at an axial end of base 110 so that optical cover 130 can slide into place along the axial direction, with coupling features 148 and 112 engaging one another.

A wide variety of optical materials can be used to form optical cover 130. Advantageous properties of such materials may include transparency, durability, low cost, and stable optical performance over time (e.g., resistance to hazing, yellowing and the like). Certain embodiments may also benefit from resistance to chemical attack, flexibility, low weight, and/or an ability to be formed by extrusion. Plastics such as polycarbonate and acrylics are suitable for many embodiments, other embodiments may be formed of glass, and still other materials may be used. Coatings may be applied to either inner surface 132 or outer surface 134 for purposes such as antireflection, polarization control and the like. Outer surface 134, while generally smooth so as not to disrupt the direction of light scattering therethrough (other than refraction at the smooth surface) may have a slightly diffuse finish so as to further obscure an external view of inner surface 132 of optical cover 130. The amount of diffusion provided by such finish is advantageously very small so that the directionality of light that is provided by the facets 136 is substantially preserved. Alternatively, or in addition to having a diffuse finish on outer surface 134, optical cover 130 can be formed of a material that has scattering sites embedded in the material itself (see FIG. 8).

Figure 3:
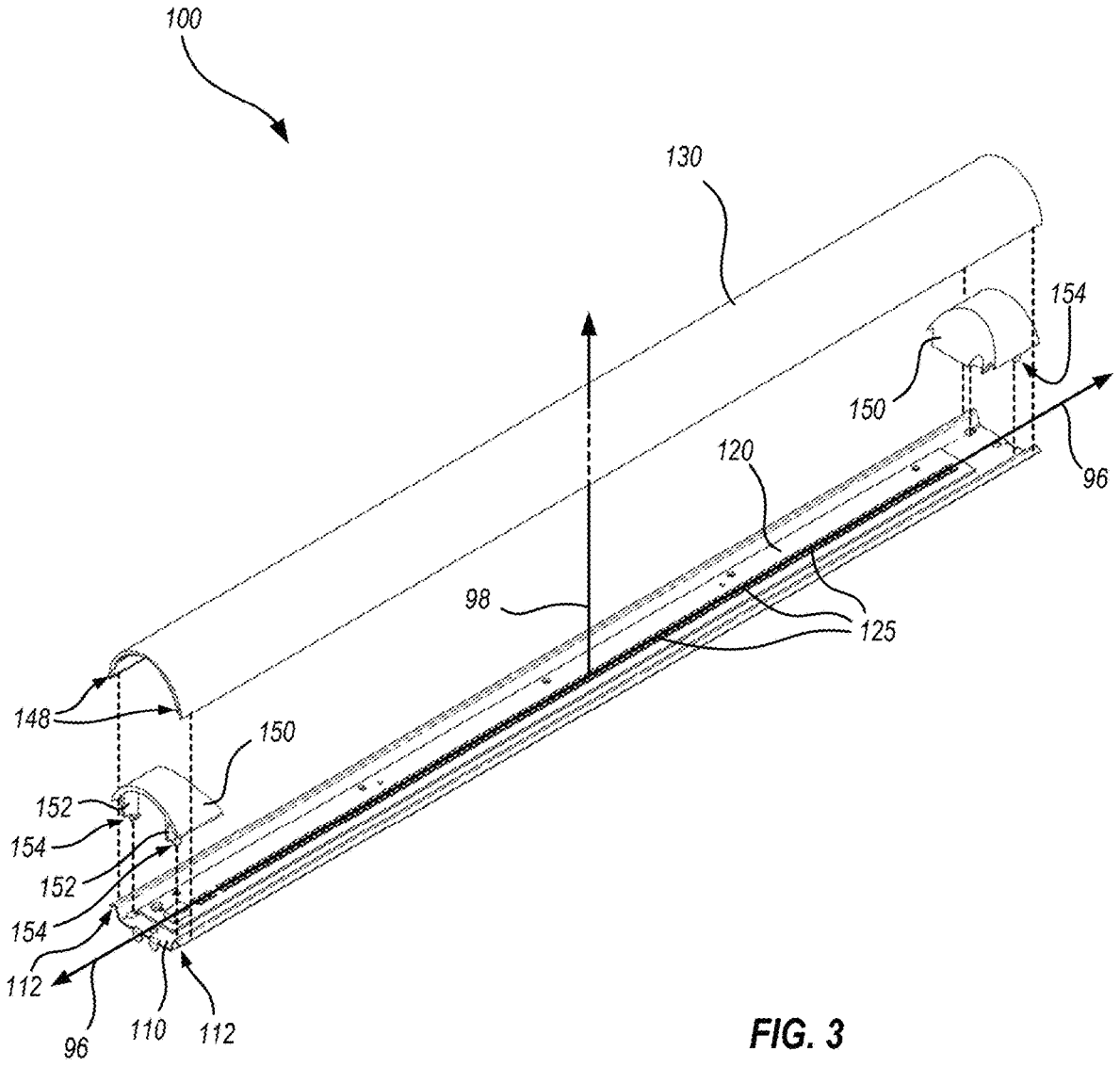
FIG. 3 is a schematic exploded diagram of the light fixture of FIG. 1, in accord with one or more embodiments.

FIG. 3 is a schematic exploded diagram of light fixture 100. In addition to the components shown in FIG. 2, end caps 150 are shown. End caps 150 couple with complementary features of base 110. For example, in FIG. 2, each end cap 150 includes a pair of legs 152 with snap fittings 154 that fit within apertures of base 110, but other coupling configurations are possible. End caps 150 serve to keep contaminants out of an interior space (e.g., a space between PCB 120 and optical cover 130) of light fixture 100. Linear axis 96 is shown, and one representative optical axis 98 is shown. From the discussion with respect to FIG. 2, it should be understood that an optical axis 98 would be defined for any cross-section of light fixture 100 that is transverse to linear axis 96, with optical axis 98 extending from linear axis 96 through a midpoint of an arc of optical cover 130.

Figure 4:
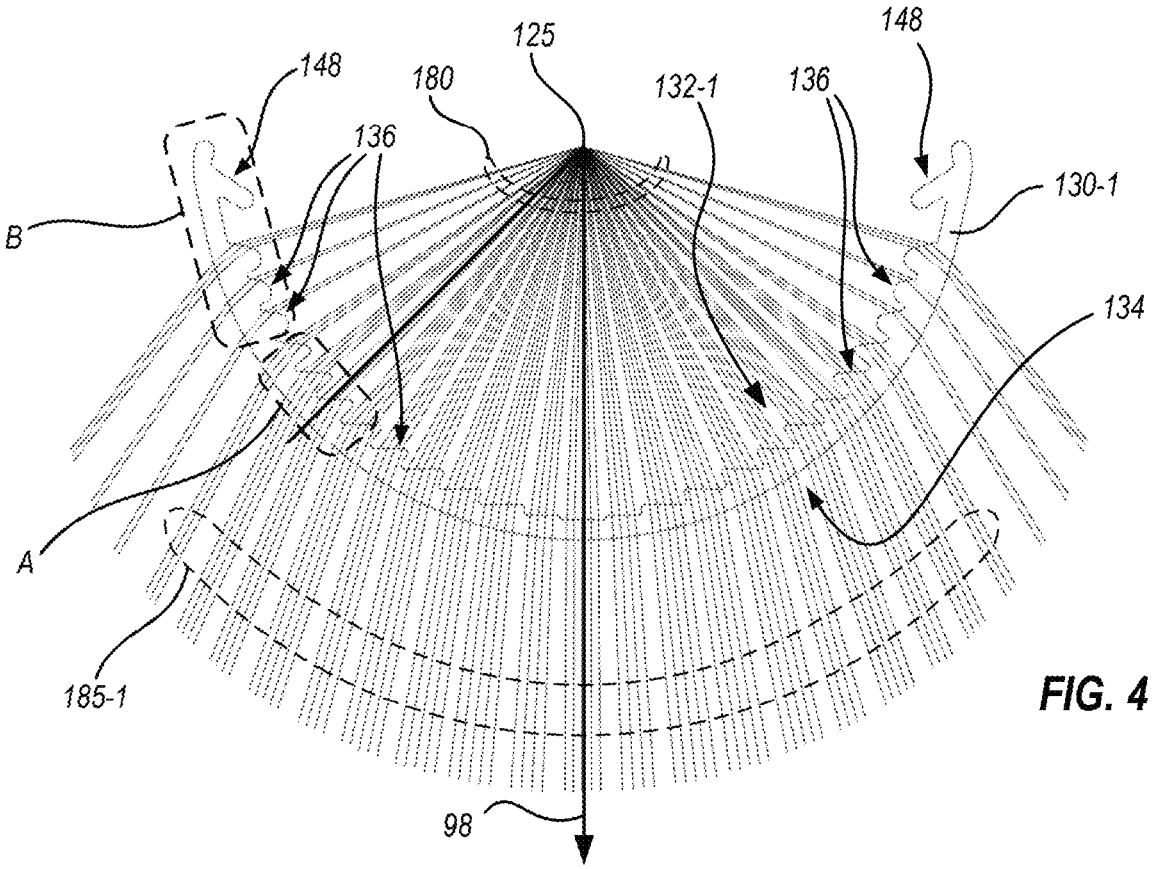
FIG. 4 schematically illustrates optical performance of an exemplary optical cover of the light fixture of FIG. 1, in accord with one or more embodiments.

FIG. 4 schematically illustrates optical performance of one particular optical cover 130-1 that can be used with, and form a part of, light fixture 100. Optical cover 130-1 is intended to provide a narrow light distribution (e.g., resembling light distribution 101, FIG. 1). An exemplary LED 125 is shown acting as a source of emitted light 180. Emitted light 180 radiates from LED 125 in a Lambertian profile, thus emitting most energy at angles near nadir, and less (but still some) energy at higher angles from optical axis 98. Because of this, only exemplary rays from LED 125 are shown at high angles. Optical cover 130-1 forms an outer surface 134 that is substantially smooth, and an inner surface 132-1 having facets 136 that redirect emitted light 180. Light 180 may be further redirected at outer surface 134, and exits optical cover 130-1 as refracted light 185-1. In FIG. 4, the rays of refracted light 185-1 that are enclosed in a dashed ellipse represent over 80% of light power from LED 125, and exit at angles within 30 degrees of optical axis 98 to form the desired narrow distribution. Sections of optical cover 130-1 labeled A and B are shown in enlarged detail in FIGS. 5A, 5B and 5C.

Figure 5A:
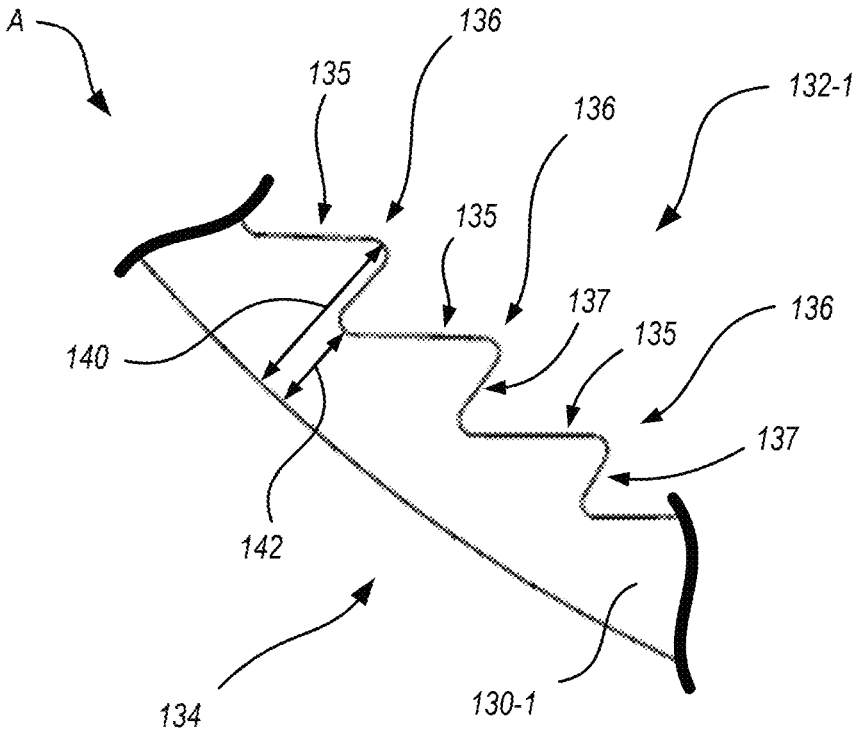
FIG. 5A is a schematic illustration of section A of the optical cover of FIG. 4 in an enlarged view, in accord with one or more embodiments.

FIG. 5A schematically illustrates aspects of selected facets 136, and other features, of optical cover 130-1 in an enlarged view of section A of optical cover 130-1. Section A includes three facets 136 on inner surface 132-1. Each facet 136 includes a refractive surface 135 and a return surface 137. Each refractive surface 135 is straight over at least part of its length, and the straight portion is oriented at an angle with respect to LED 125 (see FIG. 4) so as to refract emitted light 180 through a desired angle, given knowledge of the material of optical cover 130-1, and in accordance with Snell's Law. Each return surface 137 is roughly parallel with rays of emitted light 180, and connects each facet 136 with refractive surface 135 of an adjacent facet 136. Each facet 136 forms a peak height 140 with respect to return surface 134, and each pair of adjacent facets forms a valley height 142 therebetween, as shown. The straight portions of refractive surfaces 137 do not necessarily intersect return surfaces 137 at sharp angles, but may instead form curves transitioning from a refractive surface 137 to a return surface 137, and vice versa. Certain reasons for this are now discussed.

In embodiments herein, facets 136 are formed with an appreciation of certain constraints on manufacturability of optical covers 130. In these embodiments, optical covers 130 are formed by extrusion. For best optical performance, it would be possible to design facets 136 with refractive surfaces 135 and return surfaces 137 that extend along straight lines until they intersect at a point (e.g., point 146; see FIG. 5B). However, it can be costly to produce extrusion tooling having a cavity that ends in a sharp point, and even if produced, such shapes may not produce satisfactory extrusions. This is because the material being extruded will tend to adhere more within small cavities, than within larger cavity portions where the material can flow more freely. Friction of the extruded material is proportional to a surface area where the extruded material slides against the tooling, but the force that extrudes the material through the tooling is roughly constant throughout the volume of the material (that is, upstream of the tooling). Thus, small features in the tooling create a higher local surface area to volume ratio, but larger features will create a lower local surface area to volume ratio. Where the surface area to volume ratio is high, the material being extruded may stretch, warp and/or break during the extrusion process, and/or bits of the material can get stuck within the small features of the extrusion tooling, blocking extrusion in those areas.

Another possible problem with extending facets 138 to the theoretical intersection of a refractive surface 135 with a return surface 137, compared with rounding off the corner, is that the theoretical intersection point for a given facet will be at a greater height from outer surface 134 than height 140 shown in FIG. 5A. An isolated large height may not be a problem. However, large heights adjacent to small heights can cause problems during extrusion and for long term dimensional stability, due to mismatches in mechanical strength, shrinkage due to cooling and aging of the material, and the like between large elements and small elements that are integrally formed adjoining one another.

To mitigate these problems, embodiments herein employ two or more strategies. One strategy is to control a number of facets formed per unit of angle subtended from LEDs 125. This results in smaller refractive surfaces 135 and return surfaces 137 so as to minimize height variations across optical covers 130. This strategy conserves efficiency by maximizing a ratio of areas of refractive surfaces 135 that aim light exactly as desired, to intermediate areas that may not direct light as desired. Thus, this strategy is particularly useful in regions where emitted light 180 from LEDs 125 is most intense, to keep the overall light distribution as desired (and minimize light that is refracted or scattered less desirably). More facets may slightly increase tooling cost, but this cost disadvantage is negligible over a large number of units produced. Another strategy is to round off the angles formed where each refractive surface 135 adjoins a return surface 137 for each facet, and where return surface 137 of one facet adjoins a refractive surface 137 for an adjacent facet. This strategy is less efficient because some of emitted light 180 will be refracted through non-ideal angles along the curves. Thus, significant rounding is usually reserved for regions where emitted light 180 from LEDs 125 is less intense (such as, at high angles when LEDs 125 face nadir). This strategy has no significant impact on tooling cost.

The number of facets, the curvature radii of such curves, and other parameters can be determined to meet one or more mechanical and/or optical criteria for an optical cover 130. The mechanical criteria can be selected to promote manufacturability, and can be balanced against optical performance criteria to produce a design that has both good manufacturability and good optical performance. For example, some embodiments meet one or more criteria of overall shape of the optical cover cross-section, minimum optical cover thickness, maximum ratio of peak height to valley height (for individual peaks/valleys, or aggregates of all peaks/valleys), minimum curvature radius at any point, minimum or maximum number of facets per unit angle within a cross-section, maximum optical efficiency, minimum light in selected areas, and others. Some criteria may apply only within selected regions (such as local sets of facets, larger regions of facets, or angular ranges relative to light sources) while other criteria may apply to an entire cross-section. Some of the mechanical criteria that are met by the embodiment shown in FIG. 4 are that the portion where facets 136 exist is a semicylindrical section, the section forms an arc of at least sixty degrees about a linear axis (e.g., where LEDs 125 are located), and that inner surface 132-1 forms between eight and twenty facets within the sixty degree arc. Also, the section forms an arc of at least ninety degrees about the linear axis, and inner surface 132-1 forms between ten and thirty facets within the ninety degree arc.

Figure 5B:
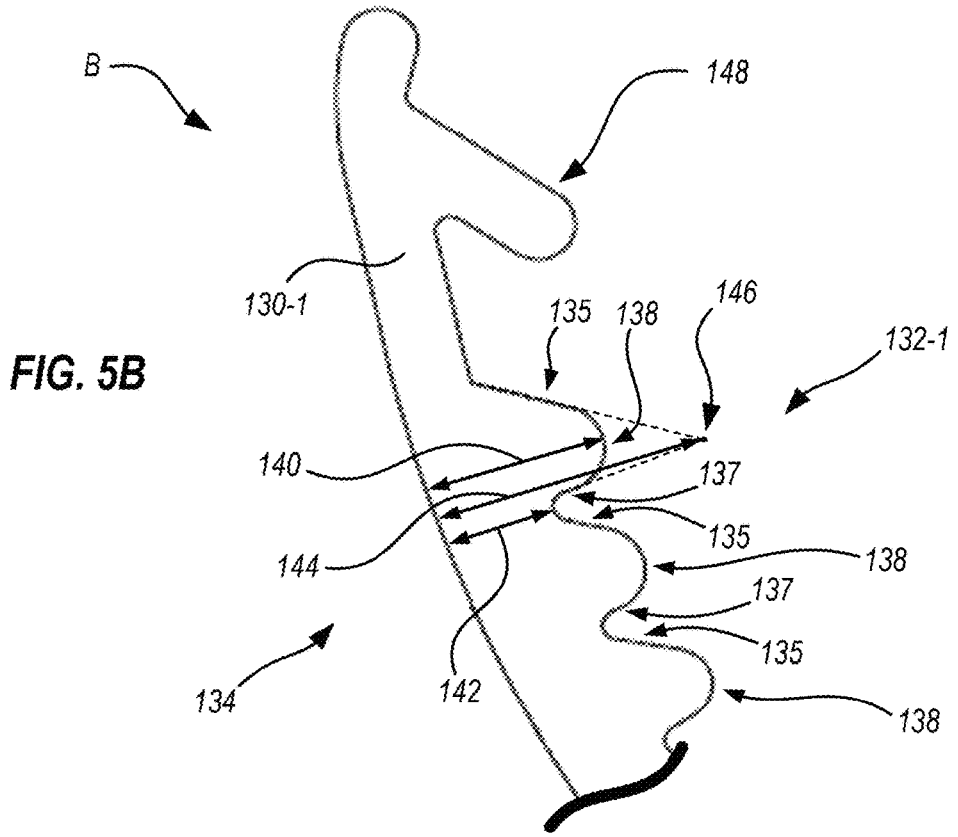
FIG. 5B is a first schematic illustration of section B of the optical cover of FIG. 4 in an enlarged view, in accord with one or more embodiments.

FIG. 5B is a first schematic illustration of the section of optical cover 130-1 labeled B in FIG. 4. Three facets 136 are illustrated (not labeled in FIG. 5B, to avoid overlapping other reference numerals; see FIG. 4). Each facet forms refractive surface 135 and return surface 137, as shown. However, each facet shown in FIG. 5B has a radius 138 applied to its furthest extent from surface 134, to minimize peak heights and/or sharp internal corners in the extrusion tooling used to produce optical cover 130-1.

Broken lines extend along the straight portions of one refractive surface 135 and one return surface 137 associated with one selected facet; the broken lines meet at a point 146, having a peak height 144 from outer surface 134, as shown. An exemplary peak height 140 of the selected facet, and a valley height 142 between the selected facet and an adjacent facet are shown, both measured from outer surface 134. A ratio of peak height 140 to valley height 142 is approximately 1.68. However, if the refractive surface 135 and return surface 137 of the selected facet had extended to point 146 instead of being reduced by providing radius 138, the resulting ratio of peak height 144 to valley height 142 would be approximately 2.51. Thus, the embodiment shown in FIG. 5B satisfies the criterion that for adjacent facets 136, a ratio of peak to valley heights do not exceed 2.0. Depending on an absolute scale to which optical cover 130 is fabricated, embodiments could also satisfy the criterion that height of a facet not exceed a given height (e.g., less than some value between peak height 144 and peak height 140). For example, in some embodiments, mechanical criteria could include: that no peak height is more than three millimeters; that no valley height between any adjacent pairs of facets is less than one-half millimeter; or that no curvature radius where a refractive surface adjoins a return surface of a given facet (or where a return surface of one facet adjoins a refractive surface of an adjacent facet) is less than 0.25 millimeter.

Figure 5C:
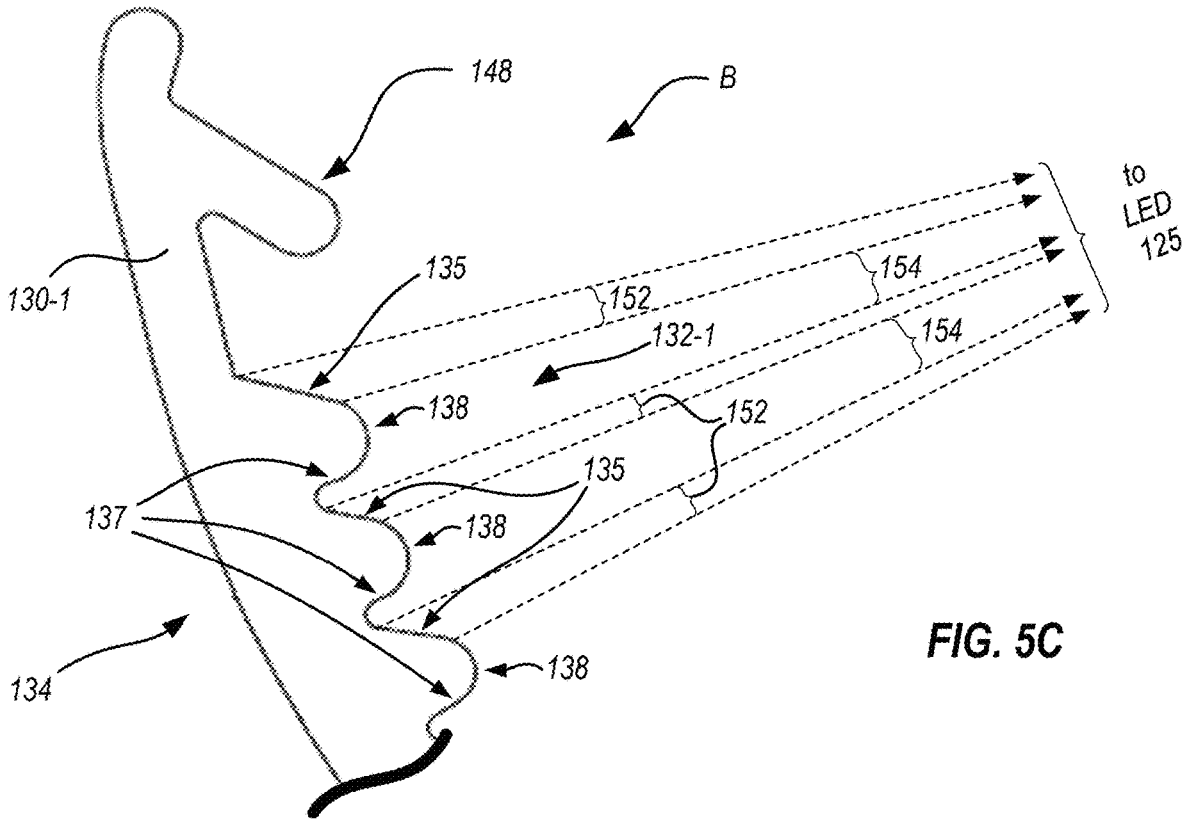
FIG. 5C is a second schematic illustration of section B of the optical cover of FIG. 4 in an enlarged view, in accord with one or more embodiments.

FIG. 5C is a second schematic illustration of the section of optical cover 130-1 labeled B in FIG. 4. That is, the shapes of the illustrated facets are identical to those shown in FIG. 5B, but different criteria are now discussed. Refractive surfaces 135 are provided to refract emitted light 180 (see FIG. 4) through specific angles, but curves 138 deviate from these ideal angles for the sake of meeting the criteria discussed in connection with FIG. 5B.

Broken lines in FIG. 5C indicate rays that trace back to LEDs 125 (outside of FIG. 5C at the magnification shown). Labeled regions 152 are regions within which emitted light 180 intersects each refractive surface 135 at the design angle that refracts the light as desired, while labeled regions 154 are regions within which emitted light 180 intersects the curves 138 at the peaks of facets 136, or the valleys between them. Thus, the light in regions 154 may be refracted non-ideally. Regions 152 and 154 can be determined for all facets of an optical cover 130 (e.g., angles from LEDs 125 that intersect refractive surfaces 135 define regions 152, and other angles define regions 154).

When optical performance of an optical cover 130 is modeled, light energy of emitted light 180 that falls within all regions 152 and 154 respectively can be calculated, given the emission characteristics of LEDs 125 and the angular ranges subtended by regions 152 and 154. Thus, the net light energy that is optimally refracted within regions 152 can be used as an optical figure of merit for optical cover 130. This optical figure of merit can be used for optimization purposes, for example, by requiring that the optical figure of merit exceed a given value while other criteria (e.g., the mechanical criteria discussed above) are also met. Requiring some value of the optical figure of merit in combination with the mechanical criteria discussed above provides an advantageous balance to the mechanical criteria alone, which could otherwise be optimized without regard to the objective of directing light as desired by optical cover 130, thereby sacrificing performance.

Figure 6:
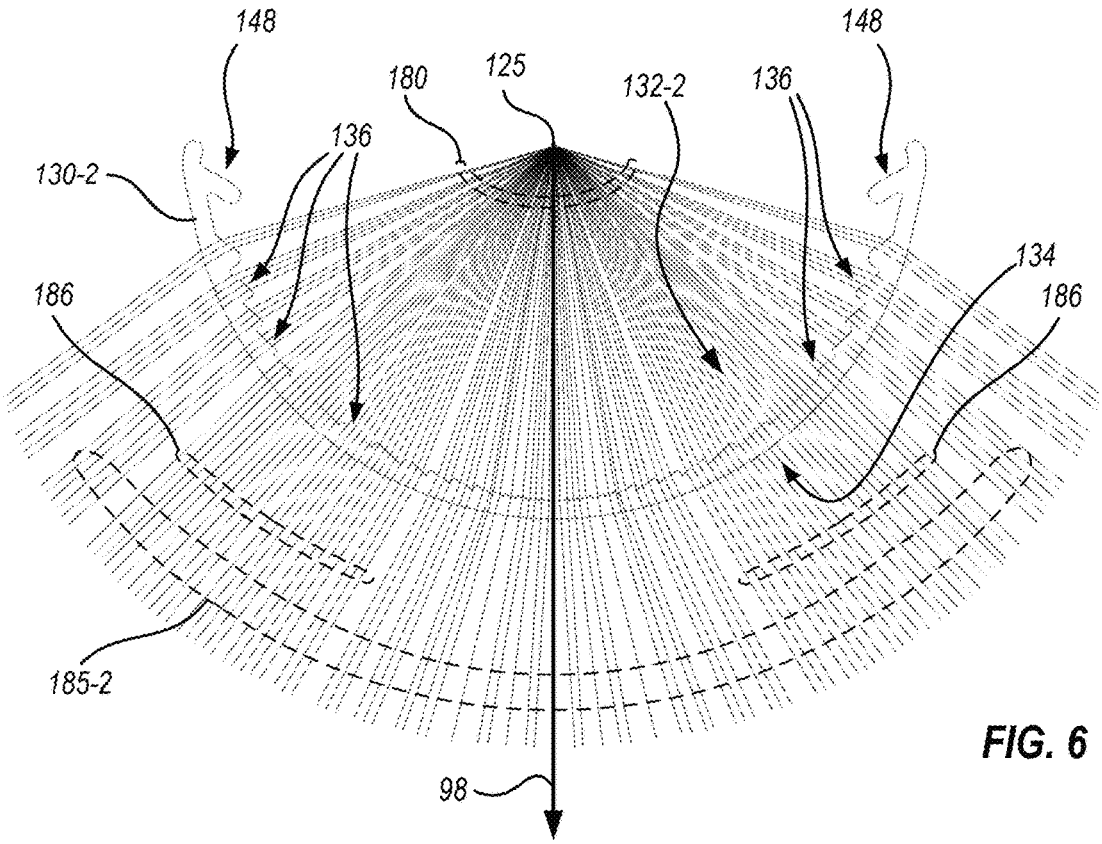
FIG. 6 schematically illustrates optical performance of another optical cover, in accord with one or more embodiments.

FIG. 6 schematically illustrates optical performance of another optical cover 130-2. Optical cover 130-2 is intended to provide a wide light distribution (e.g., resembling light distribution 102, FIG. 1). However, it is desired to modify the native Lambertian light distribution profile of LEDs 125 to smooth the light output somewhat, reducing it at nadir while increasing it at slightly higher angles on either side, and refracting at least some very high angle light downward (e.g., toward optical axis 98) to reduce glare.

FIG. 6 illustrates an exemplary LED 125 providing emitted light 180 radiating from LED 125 in a Lambertian light distribution profile, thus emitting most energy at angles near nadir (e.g., optical axis 98), and less (but still some) energy at higher angles from nadir. Because of this, only exemplary rays from LED 125 are shown at high angles. Optical cover 130-2 forms an outer surface 134 that is substantially smooth, and an inner surface 132-2 having facets 136 that redirect emitted light 180, with outer surface 134 further refracting the light somewhat, to form refracted light 185-2. In optical cover 130-2, some facets 136 disposed at high angles relative to LED 125 refract light downward, but facets 136 near optical axis 98 and up to about 40 degrees above optical axis 98 refract emitted light 180 slightly away from optical axis 98. This results in reducing the distribution of refracted light 185-2 at and about optical axis 98, and slightly concentrated the distribution of refracted light 185-2 in a range of about 30 to 46 degrees above optical axis 98, designated as ranges 186 in FIG. 6. Thus, refracted light 185-2 may be considered to form a wide, center-dim distribution.

Figure 7:
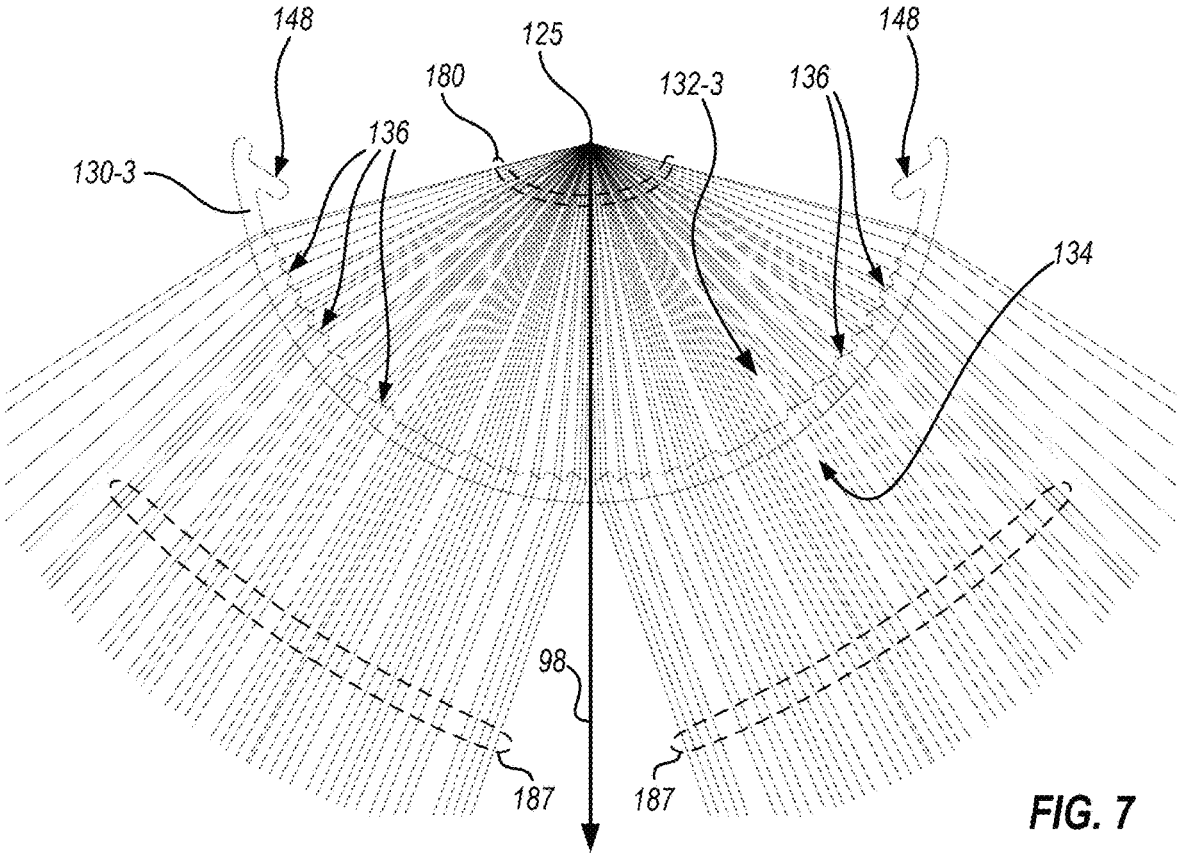
FIG. 7 schematically illustrates optical performance of another optical cover, in accord with one or more embodiments.

FIG. 7 schematically illustrates optical performance of another optical cover 130-3. Optical cover 130-3 is intended to provide an "aisle" or "bimodal" light distribution that concentrates both light emitted at very high angles, and light emitted toward optical axis 98 and toward very low angles, into lobes centered about 27 degrees on either side of optical axis 98. This distribution is useful for applications like retail environments where a linear light fixture is mounted above a center of a customer aisle, projecting light onto merchandise on shelves on either side of the aisle. Little or no light is needed directly downwards, for customers' viewing comfort, that is, the customers can look upwards toward the light fixture without being subjected to excessive glare, and the aisle will receive at least some light scattered by the shelves and merchandise.

FIG. 7 illustrates an exemplary LED 125 providing emitted light 180 radiating from LED 125 in a Lambertian light distribution profile; only exemplary rays from LED 125 are shown at high angles. Optical cover 130-3 forms an outer surface 134 that is substantially smooth, and an inner surface 132-3 having facets 136 that redirect emitted light 180, with outer surface 134 further refracting the light somewhat. In optical cover 130-3, some facets 136 disposed at high angles relative to LED 125 refract light downward, but facets 136 near optical axis 98 and up to about 23 degrees above optical axis 98 refract emitted light 180 strongly away from optical axis 98. This results in eliminating almost all the refracted light in a range of about 19 degrees on either side of optical axis 98, and concentrating two distributions of refracted light 187 into ranges of about 20 to 43 degrees on either side above optical axis 98, as shown in FIG. 7.

It will be appreciated by one skilled in the art that the techniques used to create the narrow distribution of refracted light 185-1 (FIG. 4), the wide, center-dim distribution of refracted light 185-2 (FIG. 6), and the bimodal distribution of refracted light 187 (FIG. 7) can be adapted in many ways to create other distributions. Such distributions may include, without limitation, collimated, multi-modal, and/or asymmetric distributions. All such distributions that can be created based on the faceting principles described herein are within the scope of this patent application.

Figure 8:
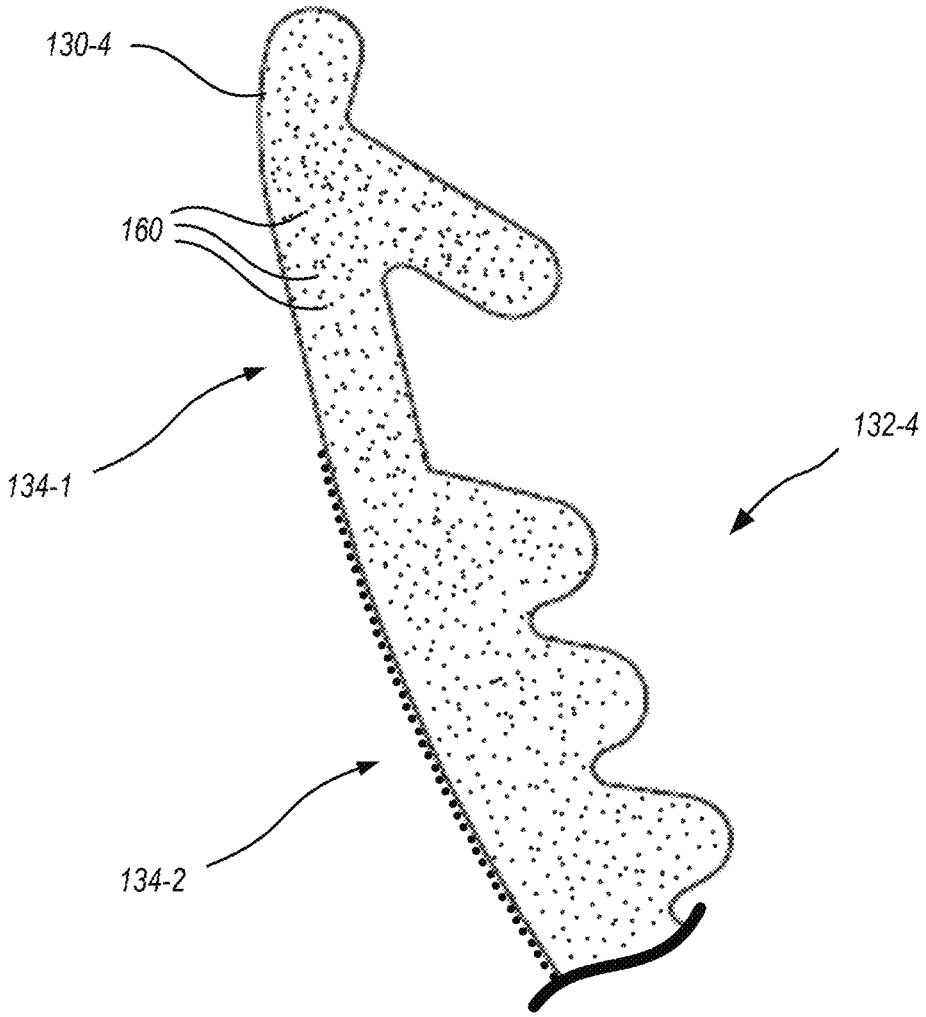
FIG. 8 schematically illustrates a portion of an optical cover to demonstrate two modalities of adding diffusion to optical characteristics of a faceted optical cover, in accord with one or more embodiments.

FIG. 8 schematically illustrates a portion of an optical cover 130-4 that demonstrates two modalities of adding diffusion to optical characteristics of a faceted optical cover. A small amount of diffusion is advantageous for color mixing and light pattern smoothing purposes, as discussed below. For example, when light fixtures using optical covers 130 as disclosed herein project light on a relatively plain surface, bands of light attributable to separate facets of the optical cover 130 may be visible. The angular separations of such bands may be on the order of a few degrees (e.g., an angular range subtended by an optical cover divided by the number of facets in the range, as discussed above). Diffusion that exceeds the angular separation of adjacent bands will tend to widen and merge the bands, to provide a less distracting projection of light. Diffusion that provides less than 20 degrees of beam spreading may be useful for some optical covers, while others can benefit from even less beam spreading, such as 5 degrees. In this sense, a degree of beam spreading is defined as an angular range over which a propagation direction of a light beam spreads, upon interacting with a scattering material or feature, as compared with an initial propagation direction of the light beam. The methods discussed below can be controlled to yield optical covers that provide the small amount of diffusion desired.

Optical cover 130-4 is formed of an optical material that has scattering sites 160 within the material itself. Scattering sites 160 may be inclusions of a second material within the optical material, or may represent the action of the optical material itself (e.g., an optical material that is dyed or otherwise has the property of scattering some of the light passing through it). Use of a second material to provide scattering sites 160 provides a number of advantages. For example, using a second material can be very inexpensive, and the concentration of such sites can be easily controlled. In some embodiments, very small amounts of the second material can be added in powder form, to the optical material in liquid form as it is being prepared for molding or extrusion to form optical cover 130-4. In this approach, the weight of the second material is usually less than about 2% of the total weight of optical cover 130-4. Alternatively, bubbles of air (or any other material with a refractive index difference, relative to the optical material) can be mixed into the optical material in liquid form. Another advantage of using a second material is to provide color mixing throughout the volume of optical cover 130-4, for light fixtures that use LEDs of different colors. A slight drawback to using scattering sites 160 in the optical material itself is that more diffusion may be imparted to light that passes through thicker portions of the material (e.g., facets 136, as discussed in connection with FIGS. 2 and 4 through 7). However, controlling peak heights to be no more than twice valley heights, as discussed above, minimizes or eliminates this problem from a practical standpoint (e.g., small differences in a small amount of diffusion are unlikely to be noticeable).

Another way to provide diffusion is through surface texturing. Optical cover 130-4 schematically illustrates two different outer surface portions, 134-1 and 134-2. Outer surface portion 134-1 is optically smooth such that it does not add diffusion to light passing therethrough. Outer surface portion 134-2 has a textured surface that diffuses light passing therethrough. Surface portion 134-2 can be textured by various methods including mechanical, chemical and/or optical (e.g., laser) ablation, by spray coating with a translucent material so as to form an irregular coating, and/or by application of a film that provides diffusion. The mechanical means include using a textured mold or extrusion die to form the optical cover, or treatments such as grinding, sanding or sandblasting of the cover after it is formed. (However, an extrusion die can only provide variations in a cross section of the optical cover, that is, one-dimensional as opposed to two-dimensional texturing). The dots used to indicate outer surface portion 134-2 are for schematic illustration only and do not necessarily represent the physical details of surface texture.

As suggested by FIG. 8, separate portions of an optical cover's outer surface can be textured or not, but of course the entire outer surface can be textured. Local texturing may be preferred when it is desired to provide more diffusion in certain regions of the light projected through an optical cover 130, than in other regions. However, texturing of outer surface 134-2 is generally somewhat more costly than providing scattering sites 160, because outer surface texturing usually requires one or more extra fabrication steps applied to individual covers 130-4, rather than the act of providing a bulk material with scattering sites that can be used to form many individual covers 130-4. It is noted that although FIG. 8 shows both scattering sites 160 and textured outer surface 134-2 in the same cover 130-4, and both can be used together, only one of these techniques or the other would typically be used.

The foregoing is provided for purposes of illustrating, explaining, and describing various embodiments. Upon reading and comprehending the present disclosure, one of ordinary skill in the art will readily recognize many alternative features, constructions, modifications and equivalents to the embodiments shown in the drawings, which may be made and/or used without departing from the spirit of what is disclosed. In but one example, although LEDs 125 emit light 180 generally downwardly in the drawings, facets 136 may refract a portion of the emitted light upwardly to form an indirect light source. Different arrangements of the components depicted in the drawings or described above, as well as additional components and steps not shown or described, are possible. Certain features and subcombinations of features disclosed herein are useful and may be employed without reference to other features and subcombinations. Additionally, well-known elements have not been described in order to avoid unnecessarily obscuring the embodiments. Embodiments have been described for illustrative and not restrictive purposes, and alternative embodiments will become apparent to readers of this patent. Accordingly, embodiments are not limited to those described above or depicted in the drawings, and various modifications can be made without departing from the scope of the claims below. Embodiments covered by this patent are defined by the claims below, and not by the brief summary and the detailed description.

What is claimed is:

1. A optical cover for a linear light source that is configured to emit light, the linear light source defining a linear axis and extending along an axial direction, the optical cover comprising:

a portion of an optical material that extends in the axial direction, wherein:

the portion of the optical material is a semicylindrical section that forms an arc of at least one hundred seventy degrees about the linear axis;

an optical axis is defined as a line passing through the linear light source and a midpoint of the arc, wherein the optical axis is orthogonal to the linear axis;

the portion of the optical material forms a constant cross-section transverse to the linear axis;

the cross-section is curved so that an inner surface of the cross-section is substantially concave and an outer surface of the cross-section is substantially convex;

the outer surface of the cross-section is substantially smooth; and the inner surface of the cross-section forms a plurality of facets, wherein:

each of the facets forms a refractive surface that refracts a corresponding portion of the light, and a return surface that connects the refractive surface with a refractive surface of an adjacent facet, each of the facets defines a peak height from the outer surface where the refractive surface adjoins the return surface, each pair of adjacent facets defines a valley height from the outer surface where the return surface of one facet adjoins the refractive surface of the adjacent facet;

the facets are arranged symmetrically about the optical axis, such that the corresponding portions of the light collectively produce a distribution that is symmetrical about the optical axis;

and wherein:

the peak heights of all facets exceed the valley heights between all adjacent pairs of facets; and for any selected facet, the peak height of the selected facet does not exceed twice the valley height between the selected facet and a facet adjacent to the selected facet; and the facets on each side of the optical axis are configured to refract the light into a far field distribution having a peak that is centered about the optical axis, and wherein a luminous flux at the peak is at least five times a luminous flux at fifty degrees from the optical axis.

2. The optical cover of claim 1, wherein none of the valley heights between all adjacent pairs of facets is less than one-half millimeter.

3. The optical cover of claim 1, wherein:

each of the facets forms a first radius of curvature where the refractive surface adjoins the return surface;

each pair of adjacent facets forms a second radius of curvature where the return surface of one facet adjoins a refractive surface of the adjacent facet; and each of the first and second radii of curvature are at least 0.25 millimeter.

4. The optical cover of claim 1, wherein each of the facets refracts the corresponding portion of the light toward the optical axis, as compared with its original propagation direction.

5. The optical cover of claim 1, wherein:

the semicylindrical section forms an arc of at least sixty degrees about the linear axis; and the inner surface forms between eight and twenty of the facets.

6. The optical cover of claim 1, wherein:

the semicylindrical section forms an arc of at least ninety degrees about the linear axis;

and\ the inner surface forms between ten and thirty of the facets.

7. The optical cover of claim 1, wherein:

the semicylindrical section forms an arc of at least one hundred seventy degrees about the linear axis; and the inner surface forms between thirty and eighty of the facets.

8. The optical cover of claim 1, wherein the optical material includes scattering sites configured to diffuse the light when it passes through the optical cover.

9. The optical cover of claim 8, wherein the scattering sites are configured to provide no more than 20 degrees of diffusion to the light.

10. The optical cover of claim 1, wherein at least a portion of the outer surface has a diffuse finish.

11. The optical cover of claim 1, further comprising one or more coupling features configured to engage with corresponding coupling features of a luminaire housing.

12. A optical cover for a linear light source that is configured to emit light, the linear light source defining a linear axis and extending along an axial direction, the optical cover comprising:

a portion of an optical material that extends in the axial direction, wherein:

the portion of the optical material is a semicylindrical section that forms an arc of at least one hundred seventy degrees about the linear axis;

an optical axis is defined as a line passing through the linear light source and a midpoint of the arc, wherein the optical axis is orthogonal to the linear axis;

the portion of the optical material forms a constant cross-section transverse to the linear axis:

the cross-section is curved so that an inner surface of the cross-section is substantially concave and an outer surface of the cross-section is substantially convex;

the outer surface of the cross-section is substantially smooth; and the inner surface of the cross-section forms a plurality of facets, wherein:

each of the facets forms a refractive surface that refracts a corresponding portion of the light, and a return surface that connects the refractive surface with a refractive surface of an adjacent facet, each of the facets defines a peak height from the outer surface where the refractive surface adjoins the return surface, each pair of adjacent facets defines a valley height from the outer surface where the return surface of one facet adjoins the refractive surface of the adjacent facet;

the facets are arranged symmetrically about the optical axis, such that the corresponding portions of the light collectively produce a distribution that is symmetrical about the optical axis;

and wherein:

the peak heights of all facets exceed the valley heights between all adjacent pairs of facets;

for any selected facet, the peak height of the selected facet does not exceed twice the valley height between the selected facet and a facet adjacent to the selected facet; and the facets on each side of the optical axis are configured to refract the light into a far field distribution having peaks between thirty-five and forty-five degrees on each side of the optical axis, and wherein a luminous flux at the peaks is at least twice a luminous flux at zero degrees or at sixty degrees on each side of the optical axis.

13. The optical cover of claim 12, wherein one or more of the facets refracts the corresponding portion of the light away from the optical axis, as compared with its original propagation direction.

14. The optical cover of claim 13, wherein when the light sources emit the light generally downwardly, the one of the one or more of the facets refracts the corresponding portion of the light into an upward direction.

15. The optical cover of claim 12, wherein none of the valley heights between all adjacent pairs of facets is less than one-half millimeter.

16. The optical cover of claim 12, wherein:

each of the facets forms a first radius of curvature where the refractive surface adjoins the return surface;

each pair of adjacent facets forms a second radius of curvature where the return surface of one facet adjoins a refractive surface of the adjacent facet; and each of the first and second radii of curvature are at least 0.25 millimeter.

17. A optical cover for a linear light source that is configured to emit light, the linear light source defining a linear axis and extending along an axial direction, the optical cover comprising:

a portion of an optical material that extends in the axial direction, wherein:

the portion of the optical material is a semicylindrical section that forms an arc of at least one hundred seventy degrees about the linear axis;

an optical axis is defined as a line passing through the linear light source and a midpoint of the arc, wherein the optical axis is orthogonal to the linear axis;

the portion of the optical material forms a constant cross-section transverse to the linear axis:

the cross-section is curved so that an inner surface of the cross-section is substantially concave and an outer surface of the cross-section is substantially convex;

the outer surface of the cross-section is substantially smooth; and the inner surface of the cross-section forms a plurality of facets, wherein:

each of the facets forms a refractive surface that refracts a corresponding portion of the light, and a return surface that connects the refractive surface with a refractive surface of an adjacent facet, each of the facets defines a peak height from the outer surface where the refractive surface adjoins the return surface, each pair of adjacent facets defines a valley height from the outer surface where the return surface of one facet adjoins the refractive surface of the adjacent facet;

the facets are arranged symmetrically about the optical axis, such that the corresponding portions of the light collectively produce a distribution that is symmetrical about the optical axis;

and wherein:

the peak heights of all facets exceed the valley heights between all adjacent pairs of facets;

for any selected facet, the peak height of the selected facet does not exceed twice the valley height between the selected facet and a facet adjacent to the selected facet; and the facets on each side of the optical axis are configured to refract the light into a far field distribution having peaks between twenty-five and thirty-five degrees on each side of the optical axis, and wherein a luminous flux at the peak is at least five times a luminous flux at zero degrees or at fifty degrees on each side of the optical axis.

18. The optical cover of claim 17, wherein none of the valley heights between all adjacent pairs of facets is less than one-half millimeter.

19. The optical cover of claim 17, wherein:

each of the facets forms a first radius of curvature where the refractive surface adjoins the return surface;

each pair of adjacent facets forms a second radius of curvature where the return surface of one facet adjoins a refractive surface of the adjacent facet; and each of the first and second radii of curvature are at least 0.25 millimeter.

* * * * *